United States Patent [19]

Smith, Jr.

[11] 4,344,607

[45] Aug. 17, 1982

[54] BLAST FURNACE SUPPORT APPARATUS

[75] Inventor: Marvin O. Smith, Jr., Bethlehem, Pa.

[73] Assignee: Bethlehem Steel Corporation, Bethlehem, Pa.

[21] Appl. No.: 211,616

[22] Filed: Dec. 1, 1980

[51] Int. Cl.[3] ..... C21B 7/00

[52] U.S. Cl. ..... 266/198

[58] Field of Search ..... 266/197, 198; 75/41, 75/42

[56] References Cited

U.S. PATENT DOCUMENTS 3,623,717 11/1971 Maloney et al. ..... 266/197
3,701,516 10/1972 Ueshima et al. ..... 266/198
3,733,065 5/1973 Greaves et al. ..... 266/198

FOREIGN PATENT DOCUMENTS 1055222 4/1959 Fed. Rep. of Germany ..... 266/198
47-40163 10/1972 Japan ..... 266/198

*Primary Examiner*—M. J. Andrews
*Attorney, Agent, or Firm*—Joseph J. O'Keefe; Michael J. Delaney; Anson W. Biggs

[57] ABSTRACT

Support apparatus for a vertically disposed furnace having a unique mantle-to-bosh configuration and lower stack section to provide for expansion and contraction between the mantle and bosh jackets.

4 Claims, 5 Drawing Figures

BLAST FURNACE SUPPORT APPARATUS

BACKGROUND OF THE INVENTION

The conventional blast furnace comprises a lower portion which includes the hearth section and bosh section and an upper portion which includes the stack, the receiving hopper, distributor, downcomer and bells. The stack or shaft section of the blast furnace is enclosed by a truncated cone-shaped shell with steep sides which are continuous from the top downward to the mantle girder. A concrete foundation is designed to support the loads from the furnace structure and its burden. The lower portion of the furnace is supported directly on the foundation. A plurality of columns surrounding the furnace are also supported on the foundation. A mantle girder mounted on top of the columns surrounds the furnace adjacent the bosh section and is connected to the furnace shell to carry the load of the furnace structure and burden from the upper portion of the furnace.

Prior to the advent of the high pressure top in the blast furnace, the accepted design for bosh steelwork consisted of bosh band construction which was connected throughout the bosh with steel hanger bars. This steelwork design was adequate since the hanger bars between the bands permitted the bosh bands to expand and contract independently without transmitting loads to the furnace columns, mantle, or tuyere jacket.

Increased furnace pressures made it necessary to change from the bosh band design to a solid bosh jacket in which holes were provided for installing in-wall cooling plates. The bosh jacket design adequately contained the brickwork construction which supported the in-wall cooling plates. However, the design did not contain the internal pressures and gases produced.

Consequently, with the development of carbon bosh technology, the solid jacket, spray-cooled bosh has evolved as an acceptable bosh design. This concept is currently in use on many operating blast furnaces.

The bosh jacket design has not been trouble-free, however. Blast furnace productivity, in many cases, has been increased significantly beyond design considerations. This has resulted in decreased effectiveness of much of the furnace cooling system. Marginal cooling in the lower stack, stop-and-go operations, and inadequate in-wall cooling plate technology contribute to premature bosh distress.

Bosh distress, which usually occurs in the mantle area, results from inadequate cooling, coupled with a high magnitude of shell restraint caused by the furnace mantle ring which is rigidly fixed to the bosh jacket. When the bosh jacket becomes overheated and expands, the mantle section does not expand equally. This differential expansion leads to high stresses in the bosh jacket and subsequent cracking through the bosh plate and inside mantle flange.

These bosh problems are associated with the mantle-to-bosh configuration.

SUMMARY OF THE INVENTION

It is, therefore, an object of this invention to provide a furnace having a unique and improved mantle-to-bosh configuration.

It is a further object of the invention to provide improved in-wall cooling of a furnace.

It is still another object of the invention to provide a furnace that permits expansion and contraction of the shell.

The present invention accomplishes these objects by providing a unique mantle-to-bosh attachment to a vertically disposed furnace shell, e.g. a blast furnace. The furnace shell is supported by means of brackets or gussets from the furnace shell to the mantle ring. The unique mantle design provides for distribution of the furnace loads to a plurality of columns surrounding the furnace, expansion and contraction of the shell and high density cooling in the lower stack area of the furnace.

DESCRIPTION OF THE PREFERRED EMBODIMENT

Figure 2:
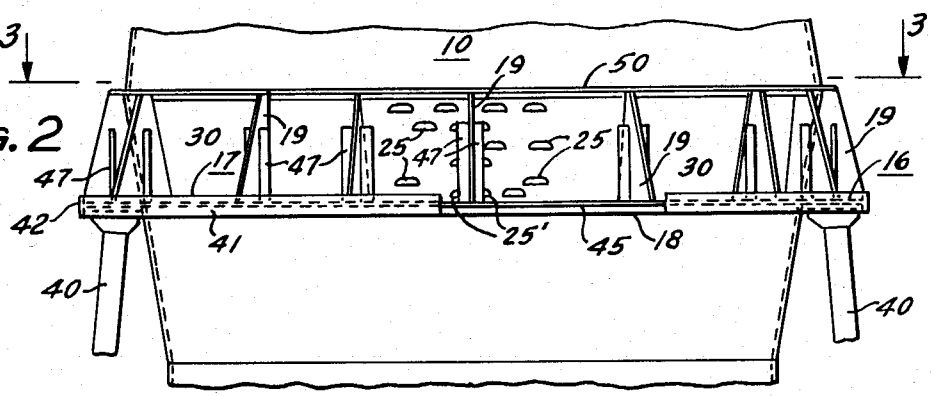
FIG. 2 is a part elevation of the bosh and lower stack portion of the blast furnace of FIG. 1.
Figure 1:
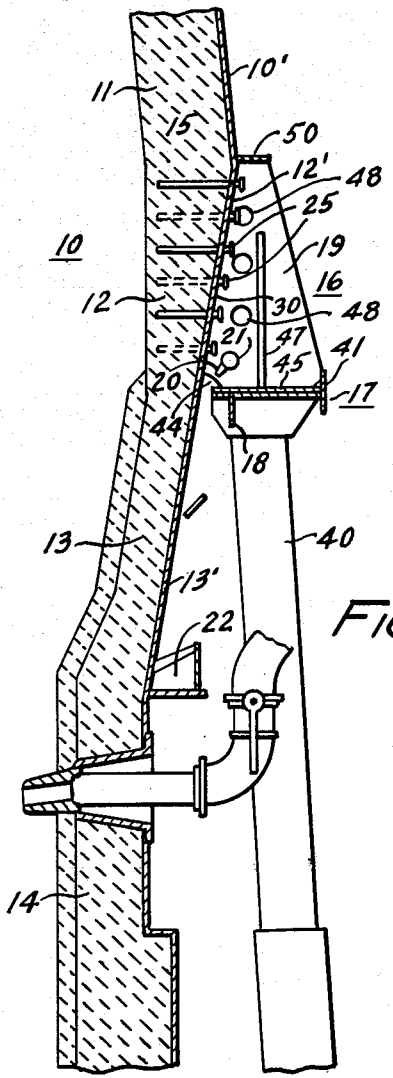
FIG. 1 is a section through the bosh and lower stack portion of a blast furnace embodying the invention.

Referring now to the drawings and particularly to FIGS. 1 and 2 for a detailed description of the invention, furnace 10 is seen to comprise generally, stack section 11, lower stack section 12, bosh section 13, and hearth section 14 joined together, as e.g. by welding, to form a vertically disposed furnace shell or jacket 10' 10'. Refractory lining 15 is provided on the inside of the furnace shell.

The blast furnace support apparatus comprises a mantle-to-bosh configuration 16 and a plurality of support columns 40 spaced around the furnace 10. The mantle-to-bosh configuration 16 includes mantle ring 17 with stiffener ring 18, flange 41 and brackets or gussets 19.

The bosh jacket 13' is spray cooled by means of a plurality of sprays 20 supplied with coolant by header 21 surrounding furnace 10 at the level of the mantle ring 17. Trough 22 collects the cooling fluid as it flows down the bosh jacket. The lower stack section 12 including the lower stack jacket 12' and the refractory associated therewith is cooled by means of a high density distribution of cooling plates 25 and 25' inserted through the lower stack jacket 12' into the refractory lining.

An annular segmental lower stack jacket 12' is provided between the upper end of the bosh section 13 and the stack section 11 of furnace 10. Mantle ring 17 surrounds the furnace 10 adjacent the upper end of bosh section 13 and a plurality of radially spaced vertically disposed gusset plates 19 are connected to the lower stack jacket 12' and the mantle ring 17.

Figure 3:
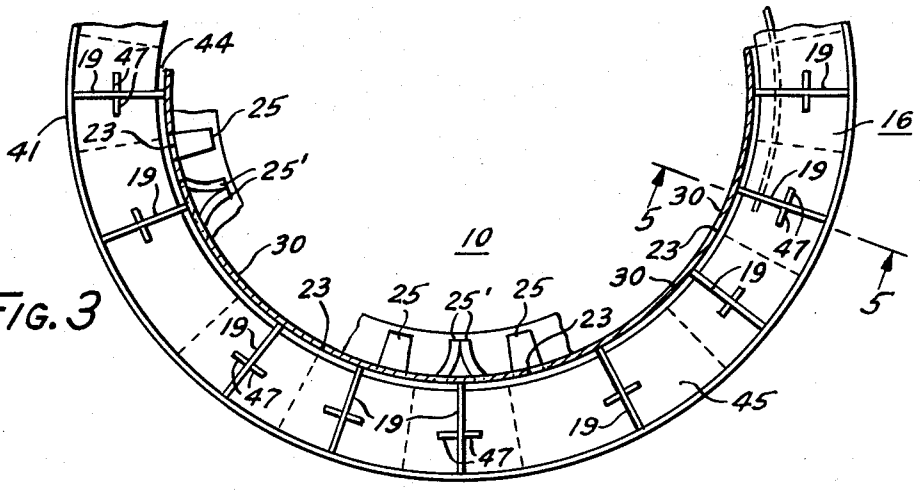
FIG. 3 is a partial plan view taken on line 3—3 of FIG. 2.
Figure 4:
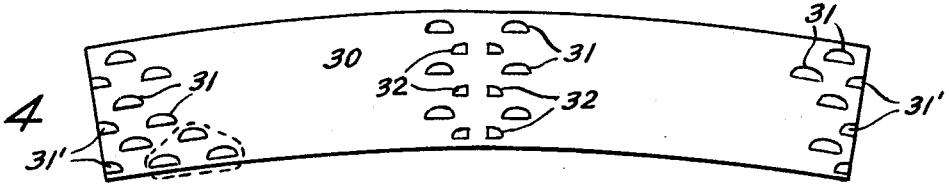
FIG. 4 is a detail of a furnace shell segment.

Referring now to FIGS. 2, 3 and 4, the annular segmental lower stack jacket 12' is comprised of a plurality of arcuate segments 30 joined together at 23, as e.g. by welding. A plurality of openings 31 and half-size openings 31' are provided in each of the arcuate segments 30 for cooling plates 25 and 25' respectively. A double row of smaller openings 32 are provided in the arcuate segments to provide for specially designed curved cooling plates on either side of gusset plates 19 which, in assembly, are welded to the arcuate segments. The arcuate segments 30 are assembled into an annular furnace section, e.g. lower stack section 12, and located between the upper end of the bosh section 13 and the stack section 11 and joined thereto. Mantle ring 17 surrounds the furnace at the upper end of the bosh section 13 and is mounted on the tops of the plurality of support columns 40.

Figure 5:
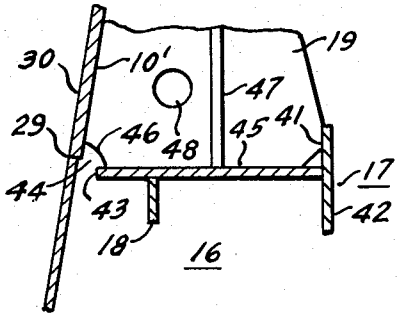
FIG. 5 is an enlarged detailed section of a portion of the mantle-to-bosh configuration.

Refer now particularly to FIG. 5 for a detailed description of the mantle-to-bosh configuration 16. Mantle ring 17 comprises an annular steel plate web 45 having a flange 41 at the outer circumference 42 to form a T-section. The inner circumference 43 of the mangle ring 17 is spaced from the furnace jacket 10' at the connection 29 between the upper end of bosh section 13 and the lower end of lower stack section 12. This space 44 allows the mantle ring 17 to expand and contract differentially with the expansion and contraction of the furnace jacket without undue stress which causes cracks in the plates and/or welds. Annular stiffener ring 18 is fixed to the underside of mantle ring web 45 spaced from the inner circumference 43 of mantle ring 17.

The connection between mantle ring 17 and the lower stack jacket 12' at the upper end of the bosh section 13 is provided by a plurality of radially spaced vertically disposed brackets or gusset plates 19 which are rigidly fixed, as by welding, to the mantle ring 17 and lower stack jacket 12'. An annular plate 50 connects the upper ends of gusset plates 19 together and to the furnace jacket 10'. The gusset plates 9 are provided with an arcuate cutout 46 adjacent the connection to the inner circumference of web plate 45 for the purpose of avoiding stresses at the gusset connection to the shell 30. Stiffener plates 47 are provided on either side of each gusset plate 19. Holes 48 are provided in the gusset plate 19 on the furnace side of the stiffener plates 47 to allow for the passage of cooling water header pipes around the furnace.

The lower stack jacket 12' comprising a plurality of arcuate segments 30 to form the lower stack section 12 is relatively thicker than the remainder of the furnace jacket 10'. The thicker shell 12' accommodates the transfer of the furnace load to the gussets 19 and thence to the mantle ring 17 and columns 40. The increased density, i.e. number, of cooling plate openings also dictates the need of a heavier plate section in the lower stack section 12.

SPECIFIC EXAMPLE

Retrofitting a conventional blast furnace is conveniently accomplished during shutdown for reline. The lower section of the shaft, which conventionally is continuous from the top and carries to about the center of the mantle girder and is welded thereto, is removed along with the existing mantle-to-bosh configuration in the manner to be described.

The retrofitted furnace of this example has a 38'-3" hearth diameter and the diameter of shaft section at the top of the mantle adjacent the top of the bosh section is 41'-1⅞" diameter inside the brick lining. The lower stack or shaft section of the furnace which is provided with extremely long and inefficient cooling plates is removed between the top of the bosh jacket and the intersection of the extension of the bosh jacket and the stack jacket, a distance of about 7'-6½" above the top of the mantle. The dismantling and erection of this section is done in segments so that the upper portion of the furnace is adequately supported during the retrofitting process.

As the shaft section is removed it is replaced with annular segmental sections that are about 7'-8" deep and have a length of arc to conveniently fit the location of the supporting columns and other ancillary equipment. The length of arc for the segments of the furnace retrofit of this example vary according to the central angles of the arc which are, e.g., 26°-15', 18°-45', 30° and 22°-30'. As the segmental sections 30 of lower stack jacket 12' are placed they are joined together and to the bosh jacket 13' and stack jacket 10' by welding. While the bosh section jacket 13' is 1½" thick plate the annular segmental segments 30 of the lower stack jacket are 2" thick to accommodate an increased number of cooling plates.

A mantle ring girder 17 having an inner 43 and outer 42 circumference is mounted on the tops of the plurality of furnace support columns 40 surrounding the furnace. The inner circumference 43 of the ring girder 17 is spaced from the furnace shell or bosh jacket 13' to provide for unencumbered expansion due to fluctuating temperatures. The present design inhibits the application of cooling water to the furnace jacket at the mantle-to-bosh connection.

The mantle ring girder 17 of the invention comprises a 2" thick plate ring and has a 2"×1'-6½" plate flange 41 vertically disposed and welded to the outer circumference 42 of the web plate 45 of mantle ring girder 17. The connection between the mantle ring girder 17 and the lower stack jacket 12' is through upstanding gusset plates 19 which are about 2" thick and are trapezoidal in shape and measure about 4'-1½" wide at the connection to the mantle girder ring and about 4½" wide at the top. The gusset plates 19 are reinforced by stiffener plates 47 which are 1½" thick and about 4" wide by about 7'-6" long welded to both sides of the gusset plates.

The mantle ring girder 17 is further reinforced by a stiffener ring 18 which measures 2" thick by 8" deep and is welded to the underside of the girder 17 and spaced from the inner circumference 43 of the ring girder 17.

The annular segmental segments 30 are provided with a plurality of holes 31, 31' and 32 to accommodate a plurality of relatively short closely spaced cooling plates 25 and 25'. In order to provide cooling to the furnace brickwork at the points of jointure 23 between the segmental plates half size holes 31' are provided in each segment to match with a cooperating half size hole 31' in the adjacent plate thus accommodating a full size cooling plate. At the points where gusset plates 19 prevent the installation of full size cooling plates small size holes 32 are provided to accommodate single cooling plates having curved or "banana" shapes to facilitate removal and replacement of the cooling plates. Horizontal rows of cooling plates are spaced about 1'-3" apart measured vertically. The vertically disposed rows of cooler plates are about 1'-6¼" apart measured horizontally.

As noted hereinbefore a high density of cooling plates in the lower stack area can be attained by the mantle-to-bosh configuration described above. Prior art design provided for the stack shell and a portion of the refractory lining to be carried directly on the mantle ring. Consequently the much greater thickness of the furnace wall at the mantle area required long and thus inefficient cooling plates, resulting in overheating of the bosh jacket. The invention thus provides for a greater density of relatively short cooling plates in the lower stack area. Half-size holes 31' are included to accommodate cooling plates in the lower stack section 12 arcuate segments 30 located adjacent the joints 23 between the segments 30 and small size cooling plates 25' are located adjacent the gusset plates 19. Full coverage of the plate area is thus accomplished.

The invention provides an improved design of the blast furnace supporting apparatus, particularly in the mantle area which can be adopted to replace the support apparatus of conventional design. A primary advantage of the invention is the elimination of the conventionally designed rigid mantle girder in the belly of the furnace and consequently the elimination of crack development in the shell and the mantle girder which occurs with expansion and contraction of the rigid mantle construction. The changes to the shell shape provided by the invention replaces the previous long in-wall cooling plates, which are impossible to remove when they fail, with an increased density of relatively short in-wall cooling plates to facilitate cooling of the complete shell area. The net result of the invention is a bosh and lower jacket structure which is free of restraint, completely exposed to adequate cooling throughout the section, and readily accessible if shell repairs become necessary.

I claim:

1. In a vertically disposed furnace having a stack section, a bosh section and a hearth section joined together and supported on a plurality of columns spaced around the furnace, a truncated cone-shaped jacket enclosing a stack section and extending downward from the top, the improvement comprising:

(a) a bosh jacket enclosing the bosh section, (b) an annular jacket extending the bosh jacket upward to intersect the truncated cone-shaped jacket, (c) a mantle ring surrounding the furnace adjacent the bosh jacket and spaced therefrom, and mounted on the tops of the plurality of columns below the intersection of the truncated cone-shaped jacket and the annular jacket, and (d) a plurality of radially spaced, vertically disposed gusset plates connected to the annular jacket and the mantle ring.

2. A furnace according to claim 1 further including (e) a stiffener ring on the underside of the mantle ring located adjacent to and spaced from the bosh jacket.

3. In a vertically disposed furnace having a stack section, a bosh section and a hearth section joined together and supported on a plurality of columns spaced around the furnace, a truncated cone-shaped jacket enclosing the stack section and extending downward from the top, the improvement comprising:

(a) a bosh jacket enclosing the bosh section, (b) an annular jacket comprising a plurality of arcuate segments joined together and connected to the top of the bosh jacket and extending the bosh jacket upward to intersect the truncated cone-shaped jacket and having a plurality of openings for cooler plates, (c) a mantle ring surrounding the furnace adjacent the bosh jacket and spaced therefrom, and mounted on the tops of the plurality of columns below the intersection of the truncated cone-shaped jacket and the annular jacket, and (d) a plurality of radially spaced vertically disposed gusset plates connected to the annular jacket and the mantle ring.

4. A furnace according to claim 3 further including (e) a stiffener ring on the underside of the mantle ring adjacent to and spaced from the bosh jacket.

* * * * *